United States Patent [19]

Perini

[11] 4,358,757

[45] Nov. 9, 1982

[54] SEISMIC MOVEMENT DETECTOR RESPONSIVE IN BOTH VERTICAL AND HORIZONTAL PLANES

[76] Inventor: Giuseppe Perini, 12 Via Ottavio Ragni, 00194 Roma, Italy

[21] Appl. No.: 136,298

[22] Filed: Apr. 1, 1980

[30] Foreign Application Priority Data

Nov. 13, 1979 [IT] Italy ..... 50810 A/79

[51] Int. Cl.[3] ..... G08B 21/00

[52] U.S. Cl. ..... 340/540; 340/601; 340/690

[58] Field of Search ..... 340/690, 566, 601, 683, 340/540; 200/61.49, 61.51

[56] References Cited

U.S. PATENT DOCUMENTS 893,997 7/1908 Haas et al. ..... 200/61.51
1,650,968 11/1927 Tedeschi ..... 390/690

FOREIGN PATENT DOCUMENTS 2730518 1/1979 Fed. Rep. of Germany ..... 340/690
980559 5/1951 France ..... 340/566

*Primary Examiner*—Glen R. Swann, III
*Attorney, Agent, or Firm*—Browdy and Neimark

[57] ABSTRACT

A device for signalling seismic movements or the like, comprising a first pair of electric contacts, one of said contacts being vibratile relatively to a horizontal rest position and the other contact of said pair being adjustably spaceable from said rest position; a second pair of electric contacts, one of the contacts being vibratile relatively to a generally vertical rest position and the other contact of said pair being adjustably spaceable from said rest position; an electric circuit connected to said two pairs of contacts and being closed when the vibratile contact of at least one of said pairs contacts its corresponding adjustable contact, at least one warning unit being inserted into said circuit to emit warning signals when said circuit is being closed.

6 Claims, 3 Drawing Figures

SEISMIC MOVEMENT DETECTOR RESPONSIVE IN BOTH VERTICAL AND HORIZONTAL PLANES

BACKGROUND OF THE INVENTION

The invention relates to a device for timely signalling earthquakes or other movements of the ground. Thanks to its small size and low cost, it can be installed in any home, public or private office, in factories, cinemas, theatres and othr premises, and it is sufficiently sensitive to weak preshocks, which generally precede the large and destructive ones to act as a timely warning and permits therefore people to flee into the open or into other safe places.

SUMMARY OF THE INVENTION

The device of the invention comprises: a first pair of electric contacts, one contact of said pair being vibratile relatively to a generally horizontal rest position and being set into vibrations by a vertical component of a quake; the other contact of said first pair being adjustably spaceable from said rest position of said vibratile contact; a second pair of electric contacts in which one contact is vibratile with respect to a generally vertical rest position and is capable of vibrating, under the impulse of a horizontal component of a quake, while the other contact of said second pair of contacts is adjustably spaceable from said vertical rest position of said vibratile vertical contact; it also comprises at least one electric circuit which is closed when at least one of the vibratile contacts of one of said pairs touches its corresponding adjustably spaceable contact; and at least one warning unit inserted into said electric circuit to emit warning signals when said electric circuit is energized by the closure of at least one of said contact pairs.

Therefore, if a quake is of an intensity sufficient to impart to at least one vibrating contact vibrations of sufficient amplitude to touch the adjustable contact, the consequent closure of the related electric circuit energizes at least one warning unit. The sensitivity of the intensity of the seismic movements of the present device can be regulated by adjusting, in each pair of contacts, the spacing between said rest position of the vibrating contact and its corresponding adjustable contact.

Differently from the known seismographs, each of both pairs of contacts is secured to a rigid support.

BRIEF DESCRIPTION OF THE DRAWINGS

For a purely exemplificative and in no way limitative purpose, an embodiment of the invention will now be described with reference to the attached drawings, wherein.

DESCRIPTION OF THE PREFERRED EMBODIMENT

Figure 1:
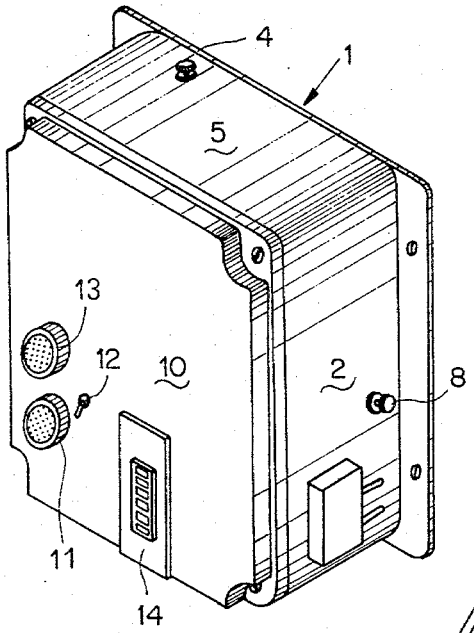
FIG. 1 shows the embodiment in its closed position.
Figure 2:
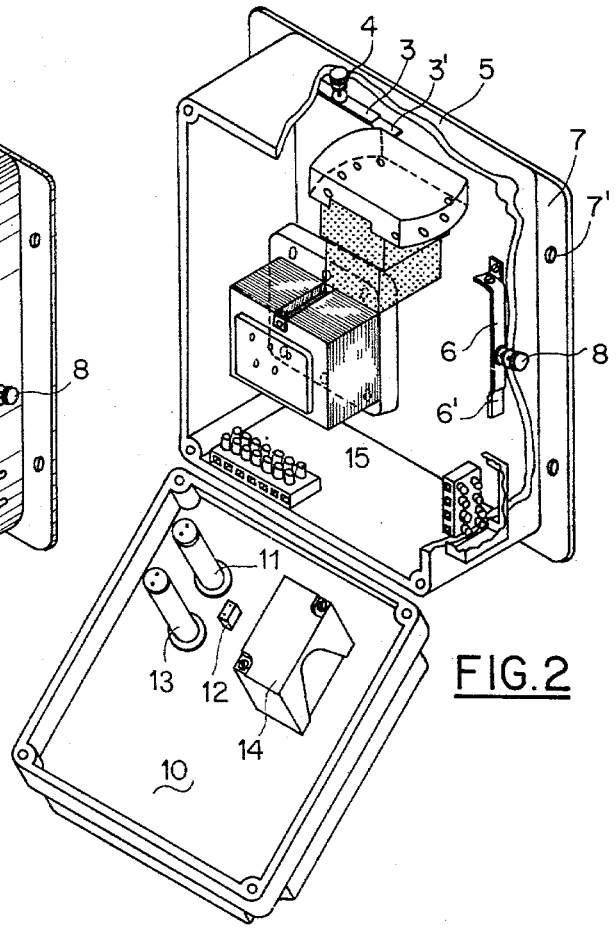
FIG. 2 shows said embodiment in its open position.

As shown in FIGS. 1 and 2, the support for both pairs of contacts has here the shape of a box, generally indicated at 1. To one of its walls 5 is fastened one end of the horizontal vibratile contact 3, whose other, free end terminates in a small counterweight 3', while its corresponding adjustable contact 4 is a screw which passes through a tapped hole bored through said wall 5. The vibratile contact 6 of the second contact pair is fastened by one of its ends to the bottom 7 of said box, and also terminates at its distal end in a small counterweight 6', while its corresponding adjustable contact 8 is also a screw which passes through the vertical lateral wall 2 within a similar tapped hole.

In this embodiment, each vibratile contact 3 and 6 consists of a resilient metal strip, while each adjustable contact 4 and 8 consists of a screw having a knurled head. As already stated, the spacings between the points of the screws 4 and 8 and the rest position of the vibratile contacts 3 and 6 are adjustable in such a manner that the latter touch the corresponding screw point only when their vibrations reach a given amplitude, imparted to them by the intensity of the quake. This servces to set the sensitivity of the device.

As shown in the figures, the bottom 7 of the box extends beyond the lateral walls of the latter and is provided with holes 7' which permit the box 1 to be fastened to a wall of the room in which the device is to be installed.

Through openings in the lid 10 of box 1 pass: a pilot lamp 11, which indicates that the device is connected to the electric mains via the main switch 12, and an optical warning unit 13, such as a lamp, which lights up when one or both contact pairs 4, 3 or 6, 8 close.

At least one acoustic warning unit, such as a buzzer or bell 14 is also energized by the closure of one or both contact pairs. Such an acoustic signal unit is shown fastened to the inside of lid 10 of box 1.

Figure 3:
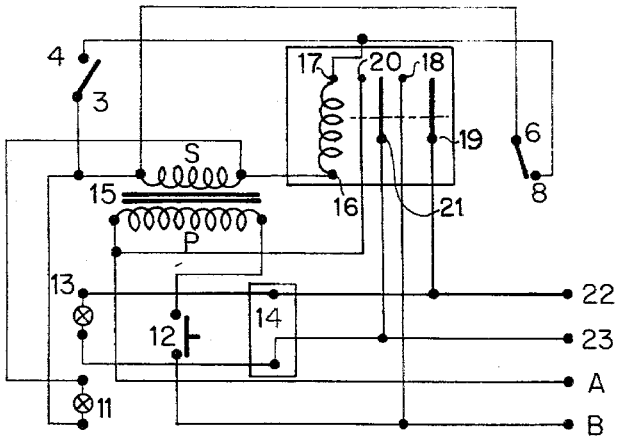
FIG. 3 shows a possible electric wiring diagram for said embodiment.

FIG. 3 shows one of the many possible electric wiring diagrams applicable to the embodiment shown in FIGS. 1 and 2.

Through the input terminals A and B and the closed switch 12, the line voltage reaches the primary winding P of a transformer 15, an output from the secondary transformer winding S of which is parallel connected to the two vibratile contacts 3 and 6.

The other end of winding is connected to one end of the feed coil 16 of a relay C, while the other end 17 of said coil S is connected to the two adjustable screws 4 and 8. Any quake imparting vibrations of sufficient amplitude to the vibratile contacts to touch the screws 4 and 8 energizes the coil 16–17 of said relay C.

This energized coil attracts the relay contacts 18 and 20. The attraction of contact 20 transfers power to contact 21 of said relay C. Similarly the attraction of contact 18 transfers power to relay contact 19. These latter contacts feed the buzzer 14 and the light 13—which are connected in parallel—via the auxiliary leads 22 and 23.

The two auxiliary leads 22 and 23 can be connected to other warning units installed in other rooms of the premises, which function simultaneously with those shown in FIGS. 1 and 2, and schematically shown at 24 in FIG. 3.

It is obvious that many changes and variants can be applied to the above illustrated embodiment without departing from the scope of the present invention.

What is claimed is:

1. A warning device for detecting occurrence of seismic movements, comprising:

a first pair of electric contacts, one of said contacts of said first pair being vibratile relative to a generally horizontal rest position, the other contact of said first pair being adjustably spaceable from said rest position;

a second pair of electric contacts, in which one of said contacts of said second pair is vibratile relative to a generally vertical rest position, the other contact of said second pair being adjustably spaceable from said rest position;

an electric circuit connected to both said pairs of electric contacts, said circuit being closed when a vibration of sufficient amplitude imparted by an earthquake to the vibratile contact of at least one of said pairs causes it to touch its corresponding adjustable contact; and at least one warning unit inserted into said circuit and energized by the closure of said circuit.

2. A device according to clam 1, wherein the contacts of each said pair of contacts are mounted upon a common support.

3. A device according to claim 1, wherein each said contact which is vibratile consists of a respective resilient metal strip fastened by one of its ends to said support.

4. A device according to clam 2, wherein each adjustable contact consists of a metal screw passing through a tapped hole provided in said support.

5. A device according to claim 1, wherein said circuit comprises:

a first electric input terminal (A) connected to one end of the primary winding (P) of a step-down transformer (15) while a second electric input terminal (B) is connected, through closure of a main switch (12), to the other end of said primary winding (P) of said transformer (15);

a secondary winding (S) of said transformer (15) whose one end is connected to the vibratile contacts (3, 6) of the first and second pair of contacts and to one terminal of a pilot lamp (11), the other terminal of which is connected to the other end of said secondary winding of said transformer;

a relay (C) with a coil terminating at each end at a respective stationary contact (16, 17), one contact (17) of said stationary contacts being electrically connected to the two adjustable contacts (4, 8) of the first and second pair of contacts and the other contact (16) of said stationary contacts being connected to the other end of the secondary winding (S) of said transformer (15), said relay (C) having additionally a first relay contact (18) and being connected to a first conductor (22) of an auxiliary line;

a third relay contact (20) connected to said first electric input terminal (A) and a fourth relay contact (21) movable towards said third relay contact (20) and connected to a second conductor (23) of said auxiliary line, said auxiliary line (22, 23) being connected to terminals of a buzzer or bell (14) and of a warning light (13) and being connected to other warning units installed in other rooms of the premises.

6. A device according to claim 5, wherein the closure of one of the contacts (3, 6) which are vibratile causes a current to flow through said coil of said relay (C) thereby determining the closure of the first and second relay contacts (18, 19) and the third and fourth relay contacts (20, 21) respectively, thereby energizing said auxiliary line (22, 23) and consequently all the warning units connected to said auxiliary line.

* * * * *